United States Patent [19]

Raskevicius

[11] 4,098,103

[45] Jul. 4, 1978

[54] CYLINDER LOCK

[75] Inventor: Leo Raskevicius, E. Hartford, Conn.

[73] Assignee: Walter Kidde & Company, Inc., Clifton, N.J.

[21] Appl. No.: 774,917

[22] Filed: Mar. 7, 1977

[51] Int. Cl.[2] ..... E05B 27/04

[52] U.S. Cl. ..... 70/364 A; 70/37 B; 70/419; 70/373; 70/375

[58] Field of Search ..... 70/276, 364 A, 378, 70/416, 419, 421, 373, 375

[56] References Cited

U.S. PATENT DOCUMENTS 2,370,800 3/1945 Kind ..... 70/276

OTHER PUBLICATIONS

"Emhart High Security Locking System", Sept. 15, 1975.

*Primary Examiner*—Robert L. Wolfe

*Attorney, Agent, or Firm*—DeLio and Montgomery

[57] ABSTRACT

A cylinder lock having a barrel with annular grooves, drivers aligned with the barrel grooves, key pins having slotted upper ends, at least some key pins having diametrically disposed chisel edges to cooperate with bitting cuts in the key for rotation of the key pins, and the drivers and key pins including provision for a magnetic interlock to prevent the drivers from hanging up on the shear line and the key pins from dropping away from the drivers, as in attempts at picking the cylinder. Projections adapted to enter into the pin slots and prevent rotation of the barrel except when the key pins are lifted to the shear line and rotationally oriented as needed are formed either on a gate or on the drivers.

4 Claims, 15 Drawing Figures

10
II
12
13
28
30
31
11
14
15
16
17
18
19
33
22
23
24
25
26
27
32
21
20
35a
35b
35c
35d
35e
35f
35
36
29

13
12
10
16
30
24'
32
31
33
21
35c
29
11
20
35
36

13
12
10
30
31
16
32
33
24'
21
24
29
11
20

CYLINDER LOCK

This invention relates to a cylinder lock construction wherein the barrel has annular grooves, the drivers are associated with a gate having projections into the grooves or have a tongue-and-groove engagement with the key pins, and the drivers and key pins are held together magnetically, as by magnetization of the drivers, the grooves in the pins requiring rotational orientation by specially bitted key teeth, as well as being vertically adjusted relative to the shear line, in order that the barrel may be turned.

In a cylinder lock as commonly constructed the barrel can be rotated whenever the lines of contact between the drivers and key pins and/or wafers, if any, are all at heights corresponding to the shear line. Due to normal manufacturing tolerances there is enough play between the parts to permit the barrel to be turned slightly, bringing the pin or tumbler holes out of alignment with the driver holes, and a picking operation can be resorted to, while maintaining a torque on the barrel, to raise each driver to a position where it clears the shear line and catches on the rim of a pin hole. When all the drivers are thus displaced the barrel can be turned. Another picking technique involves the use of special keys which can be "jiggled" in a manner which may give the same result.

It is accordingly an object of the present invention to provide a lock wherein the pins are diametrically slotted and must be rotationally oriented to clear downward projections associated with the cylinder body or alternatively wherein the pins and drivers are in tongue-and-groove engagement, requiring orientation with the tongues lying in planes perpendicular to the axis of the barrel, as well as elevation to the shear line, in order to permit rotation of the barrel.

It is a further object of the invention to provide for magnetic attachment of the pins to the drivers so that the drivers cannot be jarred, independently, to an unlocking position.

It is another object of the invention to provide a pin and barrel construction which is adapted for use not only in mortise locks but also in padlocks, key-in-knob locks, extruded housing locks and others.

It is a still further object of the invention to provide pin and driver assemblies of a special type which can be used in the same lock-set with normal pins and drivers.

It is yet another object of the invention to provide certain improvements in the form, construction, arrangement and materials of the several parts whereby the above named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawings, wherein.

Figure 1:
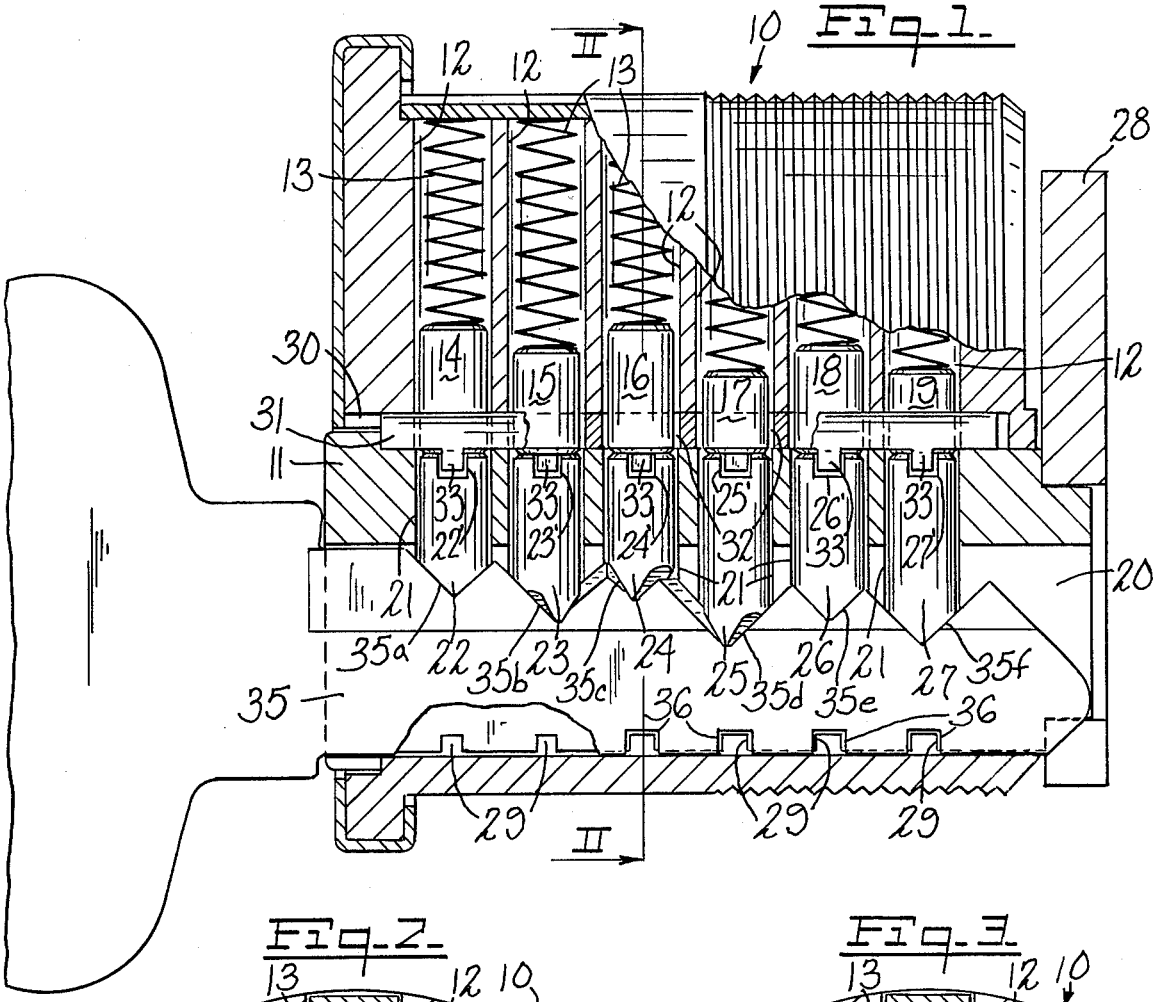
FIG. 1 represents a longitudinal vertical section of a lock cylinder with a key in the barrel and all the pins in unlocking position, part of the cylinder being shown in elevation.
Figure 2:
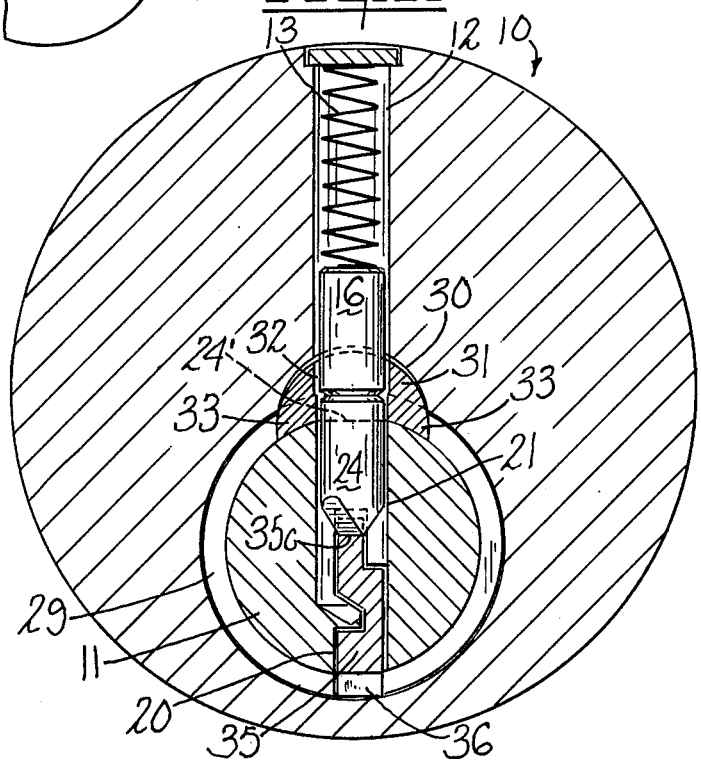
FIG. 2 represents a vertical section on the line II—II of FIG. 1.
Figure 3:
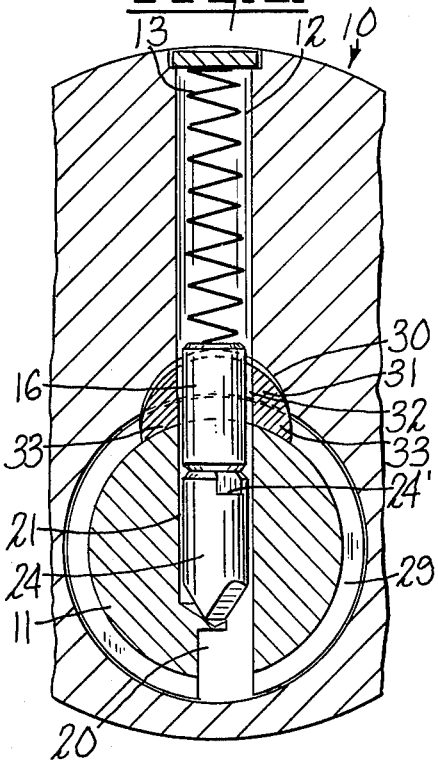
FIG. 3 represents a vertical section on the same line, with the key removed.
Figure 4:
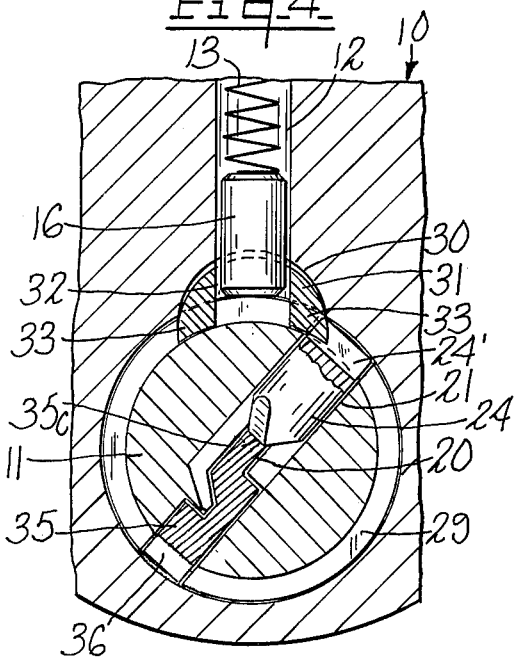
FIG. 4 represents a detail vertical section, as in FIG. 2, with the barrel rotated.
Figure 5:
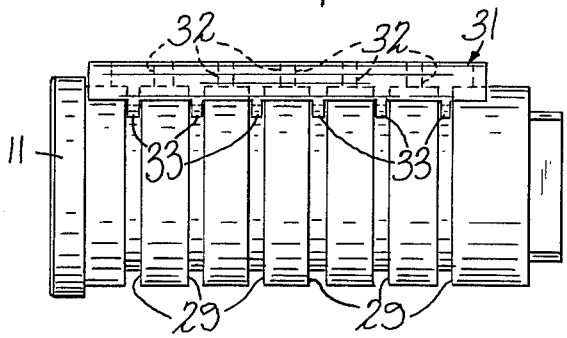
FIG. 5 represents an elevation of the barrel with the gate resting thereon.
Figure 6:
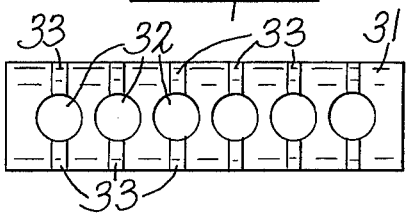
FIG. 6 represents a bottom plan view of the gate.
Figure 7:
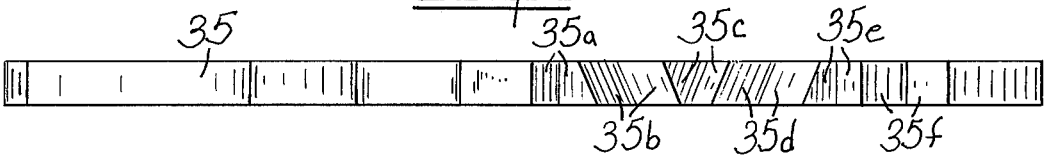
FIG. 7 represents a top plan view of the key, showing the angular bitting of the teeth.
Figure 8:
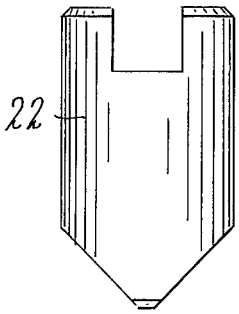
FIG. 8 represents a detail elevation, on an enlarged scale, of a key pin, for cooperation with a square-bitted key tooth.
Figure 10:
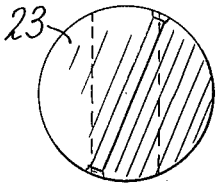
FIGS. 10 and 11 represent bottom plan view of pins with angled bases for cooperation with angle-bitted key teeth.

Referring to the drawings, and particularly to FIGS. 1 to 11, the lock is shown as comprising the cylindrical body 10, bored horizontally to form a barrel chamber adapted to receive the cylindrical plug or barrel 11 and bored vertically to provide the array of driver holes 12, each containing a spring 13 and a driver 14–19 urged downwardly by its respective spring. The barrel 11 is traversed longitudinally by the keyway 20, the top of which is intersected by an array of tumbler or key pin holes 21 adapted for alignment with the respective driver holes 12 and each containing a pin 22–27. A latch actuating cam 28 of any suitable form, is fixed on the inner end of the barrel in a manner to prevent the barrel from being pulled out of the body.

An annular groove 29 is formed around the outer surface of the barrel in alignment with each pin hole 21. The "shear line" which must be cleared for rotation of the barrel is at the periphery of the barrel, supplemented by a secondary line defined by the bottoms of all partially obstructed grooves.

The upper wall of the barrel chamber is recessed at 30 to receive the arcuately profiled gate 31 which is traversed vertically by holes 32 aligned with the driver holes 12 and the lower surface of which has projections 33 extending into the grooves 29 on each side of each hole 32.

Each driver 14–19 has a plain base and the top of each key pin 22–27 has a diametrically disposed groove 22'–27'. At their lower ends the key pins are symmetrically beveled at angles which enable them to ride over the teeth of a bitted key, the beveled surfaces defining a diametrically disposed chisel tip adapted to fit in the spaces between the key teeth.

It is apparent that, with each groove 29 blocked by a projection 33 on each side of each key pin hole 21, the barrel cannot be rotated until all the key pin grooves are in register vertically with the respective barrel grooves 29 and are oriented in planes perpendicular to the axis of the barrel. It is the function of a normal key to raise the key pins or tumblers to heights where their upper ends are on the shear line, for actuation of a conventional cylinder lock, but in the present case rotation of the pins is also required and this is provided for by the interaction of the beveled ends of the pins with square cut or angle cut teeth on the key 35.

Referring to FIG. 1, the chisel tip on the pin 22 is parallel to the groove 22' (as in FIG. 8) so that the key teeth engaging that pin must be square bitted as at 35*a*. The tip on pin 23 is angled counter-clockwise 30° from the groove 23' (as in FIG. 10 which is a bottom view) and the corresponding key teeth must be bitted at an angle, as shown at 35*b*. The tips on pins 24 and 25 are both angled clockwise 30° from the grooves 24' and 25' and the key teeth are bitted at 30° angles, as shown at 35*c* and 35*d*, such a pin being illustrated in FIG. 11. The tips on pins 26 and 27 are square bitted (like pin 22), to be actuated by square bitted key teeth, as shown at 35*e* and 35*f*. Each pin and driver is thus adapted for unlocking movement in only one of three possible rotative positions, that is, the position wherein the groove is aligned with the corresponding groove in the barrel, and each tumbler set must also be raised to the proper height, as is customary.

The key 35 is provided with notches 36 along its back edge, matching the barrel grooves, so that the key can pass by the projections 33 on the gate when the barrel is rotated 360°, as sometimes required.

Figure 12:
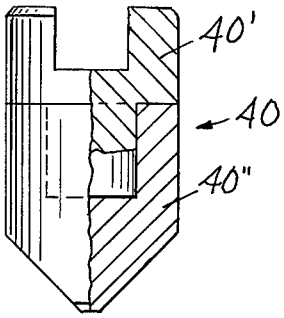
FIG. 12 represents an elevation, partly in section, of a modified form of pin, formed of two different metals.
Figure 9:
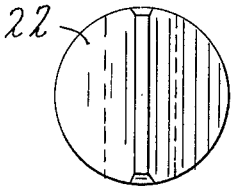
FIG. 9 represents a bottom plan view of the pin shown in FIG. 8.
Figure 11:
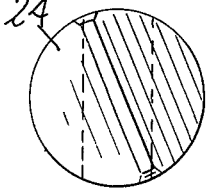

An important safety feature of the present lock is the provision of magnetized drivers which may be made of any suitable magnetizable material, an example being the ceramic magnets made by Ferronics, Inc. of East Rochester, N.Y., which are non-conductive, chemically inert, and can be magnetized either before or after assembly. The key pins are at least partially of a ferromagnetic material, and may be of two materials, as shown in FIG. 12, wherein the pin 40 has an upper portion 40' of magnetic material and a lower portion 40'' of non-magnetic material such as brass, in order to minimize the picking up of metallic particles which may be introduced into the lock deliberately or otherwise. The magnetic attraction between the driver and the key pin prevents the driver from hanging up on the shear line and the key pin from dropping below the shear line, as in certain types of lock picking operations.

Figure 13:
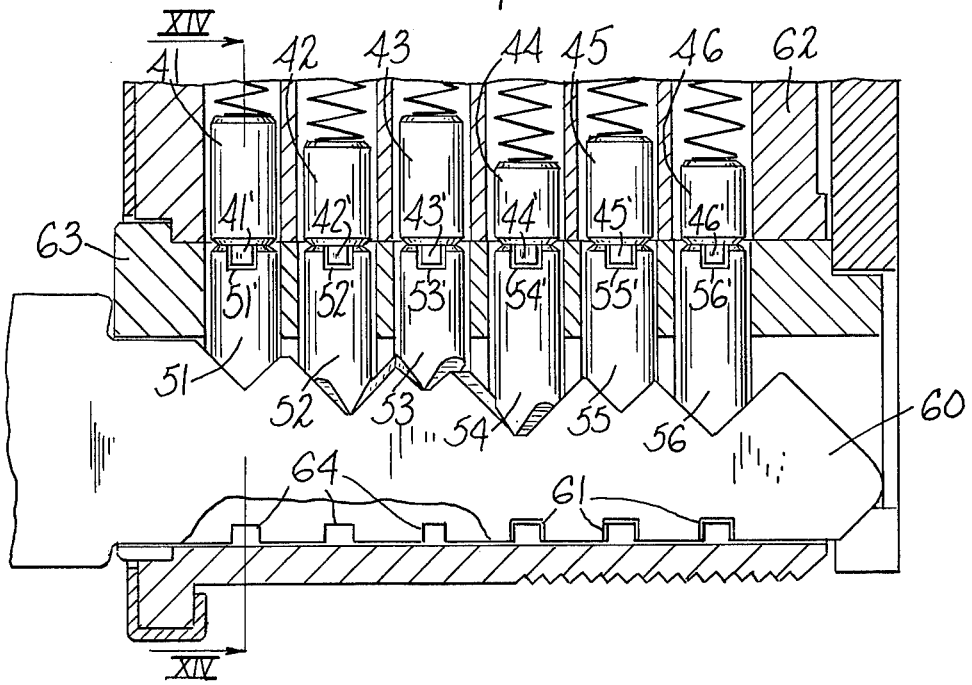
FIG. 13 represents a longitudinal vertical section of a lock cylinder, as in FIG. 1, modified by omission of the gate and addition of a tongue on the driver.
Figure 14:
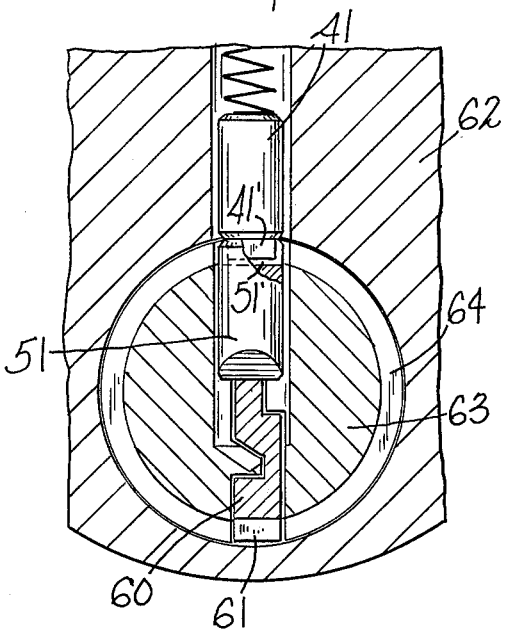
FIG. 14 represents a vertical section on the line XIV—XIV of FIG. 13.
Figure 15:
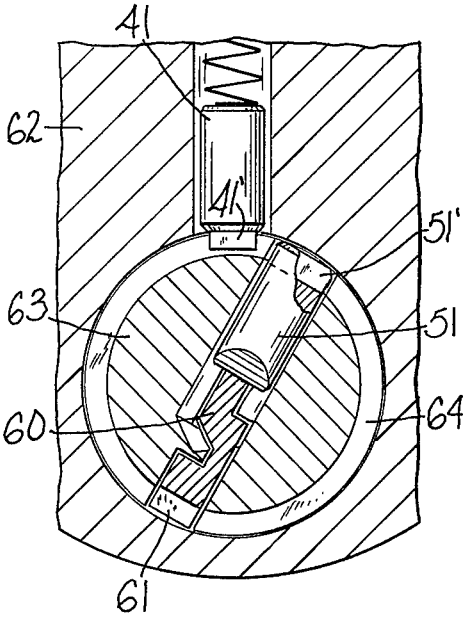
FIG. 15 represents a vertical section on the same line, with the barrel rotated.

In the modified form of lock shown in FIGS. 13 to 15 the gate is omitted. The drivers 41–46 are provided with tongues 41'–46' engaging the grooves 51'–56' in the key pins 51–56. The latter have beveled lower ends, as before, and are shown as being angled in the same pattern as described above, the key 60 being the same as the key 35, with notches 61 along its back edge to enable it to be turned 360°, past the tongues on the drivers. The cylinder body 62 corresponds to the body 10, but without the recess 30, and the barrel 63 is the same as the barrel 11, with annular grooves 64. In operation, each groove 51'–56' must be rotationally aligned with its respective groove 64 in order to release the tongue-and-groove connection between the key pins and the drivers, and each pair must be raised to the shear line. The drivers 41–46 are magnetic like the drivers 14–19.

As noted above, the special pins and drivers described herein can be used in combination with standard tumbler sets, and specifically such special pin combinations could be used in two or three of the rear positions, where there is the least wear from repeated insertion and withdrawing of the key.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A lock having a body portion and a cylindrical barrel rotatable in a bore in the body portion, the barrel having a keyway and at least one key pin hole and the body portion having the same number of driver holes each adapted to register with a key pin hole, all of said holes being circular in cross section, the surface of the barrel being provided with an annular groove intersecting each key pin hole, a driver in each driver hole, a key pin in each key pin hole, at least one key pin having a diametrically disposed groove across its upper end and adapted to be aligned with the respective annular groove and a beveled chisel tip on its lower end, and a gate fitted in the body portion adjacent to the barrel, the gate being provided with projections extending into each said annular groove to prevent rotation of the barrel when said diametrically disposed groove and its respective annular groove are not in alignment, the bore in the body portion being provided with a recess intersecting each driver hole, the gate being fitted in said recess and being traversed by a hole in register with each driver hole.

2. A lock according to claim 1 wherein the projections from the gate are located on each side of each driver hole.

3. A lock according to claim 1 wherein the barrel has a plurality of key pin holes and annular grooves.

4. A lock according to claim 1 wherein at least one key pin has its diametrically disposed groove and its chisel tip lying in different vertical planes.

* * * * *